US005431874A

United States Patent [19]

Gigliotti, Jr.

[11] Patent Number: 5,431,874

[45] Date of Patent: Jul. 11, 1995

[54] HIGH STRENGTH OXIDATION RESISTANT TITANIUM BASE ALLOY

[75] Inventor: Michael F.X. Gigliotti, Jr., Scotia, N.Y.

[73] Assignee: General Electric Company, Schenectady, N.Y.

[21] Appl. No.: 176,177

[22] Filed: Jan. 3, 1994

[51] Int. Cl.[6] ..... C22C 14/00

[52] U.S. Cl. ..... 420/418; 148/421; 420/420

[58] Field of Search ..... 420/418, 420; 148/421

[56] References Cited

U.S. PATENT DOCUMENTS

| | | | |
|---|---|---|---|
| 4,906,436 | 3/1990 | Gigliotti, Jr. et al. | 420/418 |
| 4,919,886 | 4/1990 | Venkataranan et al. | 420/420 |
| 5,041,262 | 8/1991 | Gigliotti, Jr. | 420/419 |

OTHER PUBLICATIONS

Article—Effect of Heat Treatment on Structure and Properties of IMI 829, D. F. Neal and P. A. Blenkinsop, IMI Titanium, IMI Kynoch Ltd., Birmingham, England (1980) pp. 1287–1294.

Article—Process Development and Evaluation of Gas Turbine Engine Components in IMI 829, R. M. Duncan and R. E. Goosey, IMI Titanium, IMI Kynoch Ltd., Birmingham, England (1980) pp. 429–439.

Article—Development and Evaluation of High Temperature Titanium Alloy IMI 834, D. F. Neal IMI Titanium Limited, Birminghan, England (1988) pp. 253–258.

Article–Thermo–Mechanical Processing of Titanium IMI 834, P. S. Bate, P. L. Blackwell and J. W. Brooks, Inco Engineering Products Limited, Birmingham, England (1988) pp. 287–292.

Article—Ti–1100: A New High Temperature Titanium Alloy, P. J. Bania, (1988), Timet, HTL, Henderson, N.V. 89005, USA, pp. 825–830.

*Primary Examiner*—Upendra Roy

*Attorney, Agent, or Firm*—James Magee, Jr.

[57] ABSTRACT

Titanium alloys containing aluminum, hafnium, tantalum, and silicon are found to have improved tensile strengths as well as ductility and oxidation resistance at temperatures up to and above 750° C. without embrittlement.

4 Claims, 4 Drawing Sheets

HIGH STRENGTH OXIDATION RESISTANT TITANIUM BASE ALLOY

FIELD OF THE INVENTION

The present invention relates to improvements in titanium alloys. More specifically, it relates to titanium base alloys containing aluminum, hafnium, tantalum, and silicon, which contain high tensile strength and ductility coupled with good resistance to oxidation at elevated temperatures.

BACKGROUND OF THE INVENTION

There is a continuing need for titanium alloys with high strength at high temperatures. These alloys are attractive for use in aircraft engine applications where high temperature environments may be encountered either intermittently or continuously. The temperature of use sought for advanced titanium base alloys is about 700° C. However, the achievement of high strength at high temperatures has been limited by the inability to find strengthening additives for titanium above a given level without causing embrittlement of the base metal. When strengthening additives such as aluminum or tin are made above a modest level to the hexagonal titanium, the result has been the reduction in ductility and an effective embrittlement of the metal. Accordingly, this invention teaches the ability to add alloying elements, other than tin, which add significant strength at high temperatures to the hexagonal alpha titanium base alloy without causing an embrittlement of the alloy.

It is recognized that the optimum high temperature titanium alloys have a majority phase of alpha, close packed hexagonal, titanium containing aluminum in solid solution. Typically, the advanced titanium alloys are strengthened by additions of tin, zirconium, and low levels of refractory metals. The degree of strengthening of alpha titanium is limited by the onset of the precipitation of an ordered hexagonal phase, called alpha 2, based on a composition corresponding to $Ti_3(Al,Sn)$. The onset of the precipitation of alpha 2 leads to brittle behavior. As a consequence of this embrittlement, the amount of strengthening which can be achieved by aluminum and tin additions to the titanium base metal is limited. This invention improves the strengthening of a titanium-aluminum solid solution alpha phase based matrix by utilizing hafnium, tantalum and silicon as strengthening elements and excluding tin.

Presently, commercially available advanced titanium alloys include such alloys as IMI 829, IMI 834, and Ti-1100. The composition of IMI 829 in weight percent is 5.5% aluminum, 3.5% tin, 3% zirconium, 1% niobium, 0.25% molybdenum, 0.3% silicon, and the balance titanium. The composition of IMI 834 in weight percent is 5.8% aluminum, 4% tin, 3.5% zirconium, 0.7% niobium, 0.5% molybdenum, 0.35% silicon, 0.06% carbon, and the balance titanium. The composition of Ti-1100 in weight percent is 6% aluminum, 2.8% tin, 4% zirconium, 0.4% molybdenum, 0.45% silicon, and the balance titanium.

The alloys IMI 829, IMI 834, and Ti-1100 have useful tensile strengths through 700° C. The 0.2% offset yield strength of IMI 829 is 820 MPa (119 ksi) at room temperature and about 520 MPa (75 ksi) at 500° C., 480 MPa (70 ksi) at 600° C. and 400 MPa (58 ksi) at 700° C. The ultimate tensile strength is 950 MPa (138 ksi) at room temperature and about 670 MPa (97 ksi) at 500° C., 610 MPa (88 ksi) at 600° C. and 520 MPa (75 ksi) at 700° C.

The 0.2% offset yield strength of Ti-1100 is 910 MPa (132 ksi) at room temperature and 530 MPa (77 ksi) at 650° C. The ultimate tensile strength is 1010 MPa (146 ksi) at room temperature and 630 MPa (91 ksi) at 650° C.

The room temperature tensile elongations of IMI 829, IMI 834, and Ti-1100 are 10%, 14%, and 10%, respectively. The elevated temperature tensile elongations of IMI 829 and IMI 834 are 20% at 700° C. and 16% at 200° C., respectively.

The generic behavior of these materials was described for IMI 829 by D. F. Neal and P. A. Blenkinsop, 1980, "Effect of Heat Treatment on Structure and Properties of IMI 829", *Titanium '80 Science and Technology*, ed. H. Kimura and O. Izumi, 1287–1294, Warrendale, Pa.: The Metallurgical Society of AIME; and R. M. Duncan, R. E. Goosey, R. H. Jeal, and P. J. Postans, 1980, "Process Development and Evaluation of Gas Turbine Engine Components in IMI 829", Titanium 80 *Science and Technology*, ed. H. Kimura and O. Izumi, 429–439, Warrendale, Pa.: The Metallurgical Society of AIME. IMI 834 is described by D. F. Neal, 1988, "Development and Evaluation of High Temperature Titanium Alloy IMI 834", *Sixth World Conference on Titanium*, ed. P. Lancombe, R. Tricot, and G. Beranger, 253–258, Cedex, France: Les Editions de Physique; and P. S. Bate, P. L. Blackwell, and J. W Brooks, 1988, "Thermomechanical Processing of Titanium IMI 834", *Sixth World Conference on Titanium*, ed. P. Lancombe, R. Tricot, and G. Beranger, 287–292, Cedex, France: Les Editions de Physique. Ti-1100 is described by P. J. Bania, 1988, "Ti-1100: A New High Temperature Titanium Alloy", *Sixth World Conference on Titanium*, ed. P. Lancombe, R. Tricot, and G. Beranger, 825–830, Cedex, France: Les Editions de Physique.

By contrast, the alloy of this invention differs from the above-mentioned commercial alloys in that it uses hafnium and tantalum as solid solution elements, while excluding tin. Our alloy affords higher strengths at high temperatures and superior room temperature ductility.

SUMMARY OF THE INVENTION

Accordingly, one object of the present invention is to provide an alloy substantially free of tin that strengthens a titanium-aluminum solid solution by utilizing hafnium and tantalum.

Another object is to provide an alloy which can be used effectively at temperatures up to and above 750° C. Still another object of this invention is to provide an alloy which has acceptable ductility at room temperature and good environmental resistance, making the alloy suitable as a matrix in a metal-matrix composite. An application for the alloy would be in titanium matrix composites that are reinforced with filaments such as carbon, silicon carbide, and mixtures thereof.

Generally speaking, this is achieved by providing a titanium base alloy composition that is substantially tin-free in which the majority matrix phase is the close packed hexagonal phase of titanium and it is strengthened by solid solution elements aluminum, hafnium, tantalum, and silicon. Substantially free of tin and substantially tin-free mean that tin is deliberately not added as part of the alloy composition. Any tin present in the alloy would be as an impurity.

A composition range of the alloy would be about 7.5 to 8.5 weight percent aluminum; about 4.0 to 6.0 weight percent hafnium; about 4.0 to 6.5 weight percent tantalum; about 0 to 0.5 weight percent silicon; and the balance titanium. A preferred composition would be about 8 weight percent aluminum, about 5.5 weight percent hafnium, about 5.6 weight percent tantalum, 0.2 weight percent silicon, and the balance titanium. Small additions, less than about 1 weight percent of scandium, yttrium, or the lanthanum group elements could be used to control grain growth during thermomechanical processing.

BRIEF DESCRIPTION OF THE DRAWINGS

The invention and the description of the invention which follows will be understood with greater clarity by reference to the accompanying drawings in which.

DETAILED DESCRIPTION OF THE INVENTION

Figure 1:
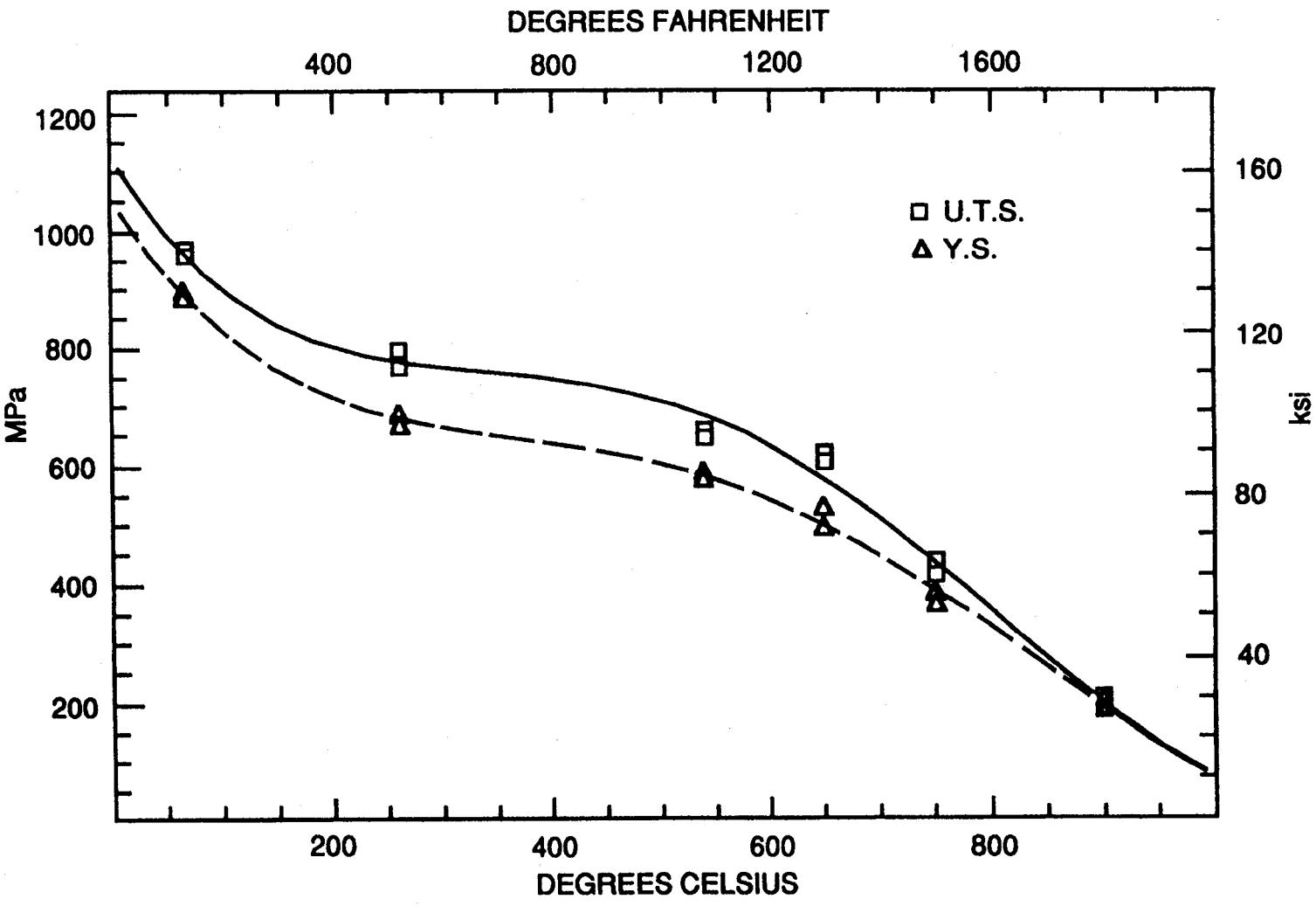
FIG. 1 is a graph of the tensile strength of an alloy containing 8.0 weight percent aluminum, 5.5 weight percent hafnium, 5.6 weight percent tantalum, 0.2 weight percent silicon, and the balance titanium versus temperature in degrees Celsius and Fahrenheit.

We have discovered that the additions of about 7.5 to 8.5 weight percent aluminum, about 4.0 to 6.0 weight percent hafnium, about 4.0 to 6.5 weight percent tantalum, and about 0 to 0.5 weight percent silicon to hexagonal structured titanium results in increased solid solution strengthening of the alpha phase. We have also observed the greatly enhanced ductility of the claimed alloy in comparison to a titanium alloy containing tin. The following tests and data further describe the outstanding properties of the claimed high strength titanium alloy.

A prior art alloy containing 7.5 weight percent aluminum, 2.8 weight percent tin, 5.5 weight percent hafnium, 3.7 weight percent tantalum, 0.2 weight percent silicon, and the balance titanium, was prepared by hot rolling from 1200° C. and heat treated at 710° C. for 48 hours. At room temperature the ultimate tensile strength was 928 MPa (135 ksi) with 0.1% elongation at failure; at 650° C. the ultimate tensile strenght was 767 MPa (111 ksi) with 1.5% elongation at failure. The low ductility (elongation at failure) limits the utility of this composition. With the exception of containing no yttrium, this alloy would lie within the range specified in claim 5 of U.S. Pat. No. 4,906,436.

Tests were done on an alloy of this invention with the composition: 8 weight percent aluminum, 5.5 weight percent hafnium, 5.6 weight percent tantalum, 0.2 weight percent silicon, and the balance titanium. This differs chiefly from the above-mentioned prior art alloy in the absence of tin. The alloy was hot rolled from a starting temperature of 1200° C. The hot rolled plate was evaluated after three different heat treatments. Heat treatment "A" was conducted at 900° C. for 24 hours, plus an additional 24 hours at 750° C. Heat treatment "C" was conducted at 900° C. for 8 hours, plus an additional 8 hours at 750° C. The third heat treatment, "D" was conducted at 1200° C. for 2 hours, followed by 8 hours at 900° C., plus an additional 8 hours at 750° C.

Heat treatments "A" and "C" resulted in a single phase microstructure of equiaxed alpha grains. Heat treatment "D" resulted in a single phase microstructure of large alpha grains typical of a solution treatment in an all beta field followed by ageing in an all-alpha field.

Tensile tests were conducted on the alloy in the three heat treatments. The data are listed in Table 1. With reference to Table 1, "0.2% Yield Strength" is the stress after 0.2% plastic elongation as determined from the offset on a load chart of the test; "% Elongation at Maximum Load" is the percent plastic deformation when the specimen reaches its ultimate tensile strength, as determined from the offset on a load chart of the test; "% Elongation at Failure" is the percent plastic deformation when the specimen breaks, as determined from the offset on a load chart of the test; and "% Reduction of Area" is the percent reduction in the specimen gauge cross section area, as determined by measurements before and after test. The tests were conducted in air at room temperature and in a vacuum at elevated temperatures.

TABLE 1

TENSILE BEHAVIOR OF
$Ti_{(BALANCE)}$-8 wt. % Al-5.5 wt. % Hf-5.6 wt. % Ta-0.2 wt. %Si

| Test Temp. | | | 0.2% Y.S. | | U.T.S. | | | | |
|---|---|---|---|---|---|---|---|---|---|
| °C. | °F. | H.T* | MPa | ksi | MPa | ksi | % $El_m$ | % $El_f$ | % RoA |
| 20 | 68 | A | 887 | 128.7 | 956 | 138.7 | 6.9 | 11.3 | 13.2 |
| 20 | 68 | A | 896 | 130.0 | 970 | 140.7 | 7.5 | 13.5 | 15.7 |
| 20 | 68 | A | 883 | 128.0 | 954 | 138.3 | 4.0 | 9.6 | 8.1 |
| 260 | 500 | A | 695 | 100.8 | 803 | 116.4 | 12.1 | 18.9 | 25.7 |
| 260 | 500 | A | 674 | 97.8 | 772 | 111.9 | 10.3 | 15.6 | 26.5 |
| 540 | 1004 | A | 578 | 83.8 | 661 | 95.9 | 9.2 | 15.9 | 33.3 |
| 540 | 1004 | A | 569 | 82.5 | 649 | 94.1 | 10.5 | 16.5 | 31.6 |
| 650 | 1202 | A | 524 | 76.0 | 621 | 90.1 | 9.7 | 18.3 | 35.0 |
| 650 | 1202 | A | 499 | 72.3 | 607 | 88.1 | 10.0 | 27.0 | 44.9 |
| 750 | 1382 | A | 395 | 57.3 | 432 | 62.6 | 1.1 | 33.7 | 48.7 |
| 750 | 1382 | A | 372 | 54.0 | 414 | 60.1 | 1.6 | 34.2 | 37.3 |
| 900 | 1652 | A | 204 | 29.6 | 204 | 29.6 | 0.2 | 147.7 | 94.5 |
| 900 | 1652 | A | 172 | 24.9 | 172 | 24.9 | 0.2 | 121.2 | 91.2 |
| 1000 | 1832 | A | 48 | 6.9 | 73 | 10.6 | 0.6 | 154.8 | 91.9 |
| 1000 | 1832 | A | 83 | 12.1 | 83 | 12.1 | 0.2 | 104.4 | 92.6 |
| 20 | 68 | C | 874 | 126.7 | 932 | 135.1 | 5.8 | 11.5 | 12.0 |
| 260 | 500 | C | 644 | 93.4 | 749 | 108.7 | 12.5 | 17.5 | 29.0 |
| 540 | 1004 | C | 543 | 78.8 | 634 | 92.0 | 14.0 | 21.2 | 31.2 |
| 650 | 1202 | C | 483 | 70.0 | 572 | 82.9 | 12.1 | 17.5 | 15.7 |
| 750 | 1382 | C | 405 | 58.7 | 450 | 65.3 | 2.2 | 33.1 | 33.3 |
| 900 | 1652 | C | 210 | 30.4 | 210 | 30.4 | 0.2 | 135.2 | 94.5 |

TABLE 1-continued

TENSILE BEHAVIOR OF
$Ti_{(BALANCE)}$-8 wt. % Al-5.5 wt. % Hf-5.6 wt. % Ta-0.2 wt. %Si

| Test Temp. | | | 0.2% Y.S. | | U.T.S. | | | | |
|---|---|---|---|---|---|---|---|---|---|
| °C. | °F. | H.T* | MPa | ksi | MPa | ksi | % $El_m$ | % $El_f$ | % RoA |
| 1000 | 1832 | C | 83 | 12.1 | 84 | 12.2 | 0.1 | 56.1 | 52.0 |
| 20 | 68 | D | 784 | 113.7 | 806 | 116.9 | 0.9 | 5.7 | 1.7 |
| 260 | 500 | D | 631 | 91.5 | 697 | 101.1 | 8.2 | 11.8 | 16.3 |
| 540 | 1004 | D | 479 | 69.4 | 522 | 75.7 | 2.7 | 8.8 | 41.4 |
| 650 | 1202 | D | 496 | 72.0 | 527 | 76.5 | 0.9 | 6.4 | 27.4 |
| 750 | 1382 | D | 460 | 66.7 | 491 | 71.2 | 1.3 | 5.7 | 3.7 |
| 900 | 1652 | D | 160 | 23.2 | 163 | 23.7 | 0.5 | 114.5 | 94.5 |
| 1000 | 1832 | D | 37 | 5.3 | 84 | 12.2 | 1.5 | 86.3 | 88.8 |

*Heat Treatment Code:
A: 900° C., 24 hours, plus 750° C., 24 hours (1652° F./1382° F.)
C: 900° C., 8 hours, plus 750° C., 8 hours (1652° F./1382° F.)
D: 1200° C., 2 hours, plus 900° C., 8 hours plus 750° C., 8 hours (2192° F./1652° F./1382° F.)

Figure 2:
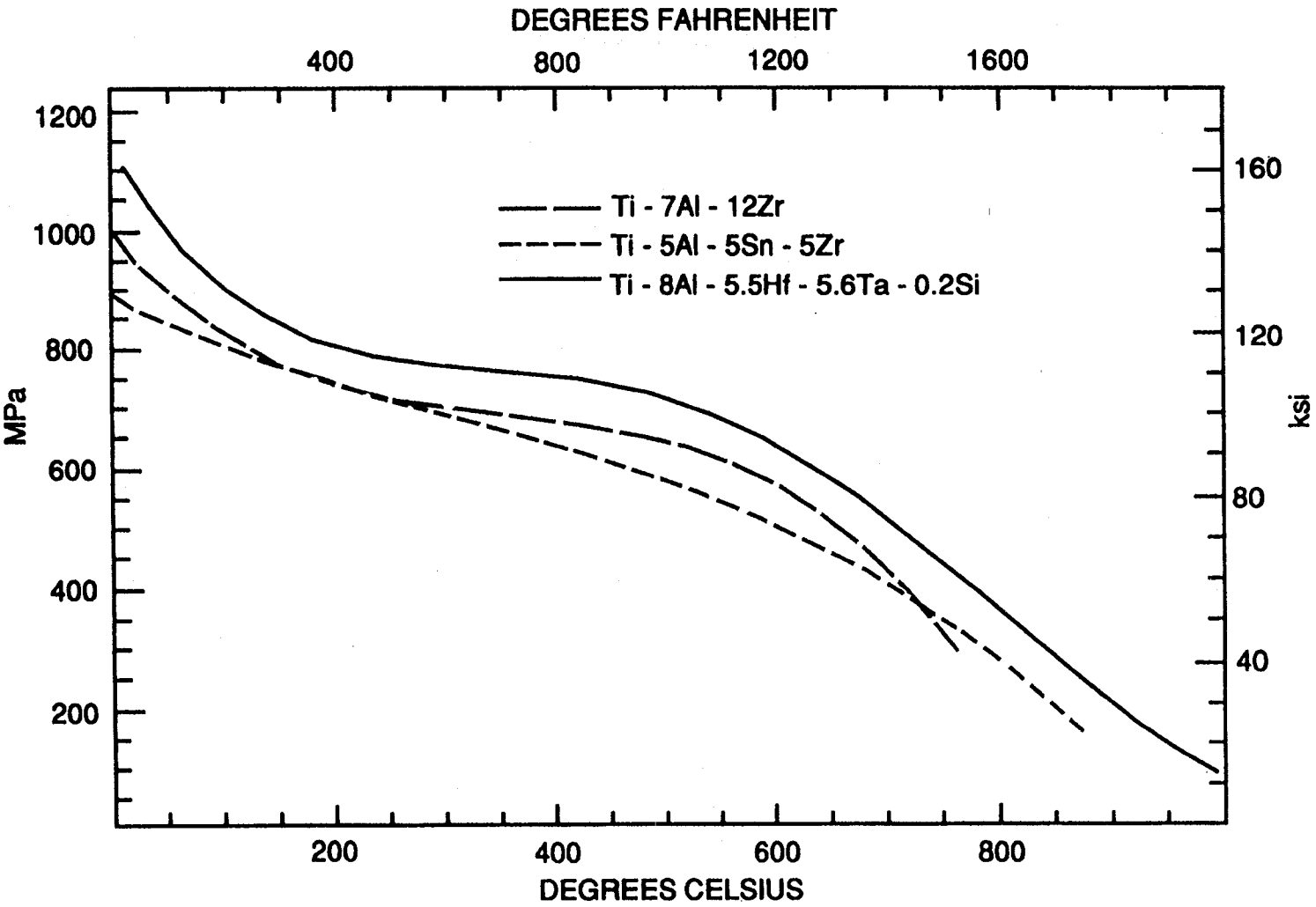
FIG. 2 is a graph of the ultimate tensile strength of alpha titanium alloys versus temperature in degrees Celsius and Fahrenheit, showing higher strength for the claimed alloy.

The yield strength and ultimate tensile strength for the alloy after heat treatment "A" is displayed in FIG. 1. The strength of the alloy is surprisingly high. The ultimate tensile strengths at 750° C. (1380° F.) ranged from 414 to 491 MPa (60.1 to 71.2 ksi). The tensile strength exceeds other alpha titanium alloys at the highest temperatures. For example, at 760° C. (1400° F.), the tensile strengths of titanium alloys $Ti_{(BALANCE)}$-5 wt. % Al-5 wt. % Sn-5 wt. % Zr; $Ti_{(BALANCE)}$-5 wt. % Al-2.5 wt. % Sn; $Ti_{(BALANCE)}$-6 wt. % Al-2 wt. % Sn-4 wt. % Zr-2 wt. % Mo; or $Ti_{(BALANCE)}$-6 wt. % Al-4 wt. % V were measured as 305, 170, 243, 194 MPa (44.3, 24.6, 35.3, 28.1 ksi), respectively (Carl R. Johnson and John Do Grimsley, 1970, "Short-Time Stress Rupture of Prestressed Titanium Alloys under Rapid Heating Conditions", NASA Technical Note NASA TN D-6052, Goddard Space Flight Center, Greenbelt, Md. 20771); and the tensile strength of $Ti_{(BALANCE)}$-7 wt. % Al-12 wt. % Zr at 760° C. (1400° F.) is 269 MPa (39 ksi) (Williams, D. N., R. A. Wood, H. R. Ogden, and R. I. Jaffee, 1963, "The Development of High Strength Alpha-Titanium Alloys Containing Aluminum and Zirconium", *Transactions of the Metallurgical Society of AIME*, 227, 563–571). The ultimate tensile strengths of the strongest of these alloys ( Ti 555 and Ti 7–12) are compared in FIG. 2 with the strength of $Ti_{(BALANCE)}$-8 wt. % Al-5.5 wt. % Hf-5.6 wt. % Ta-0.2 wt. % Si.

Figure 3:
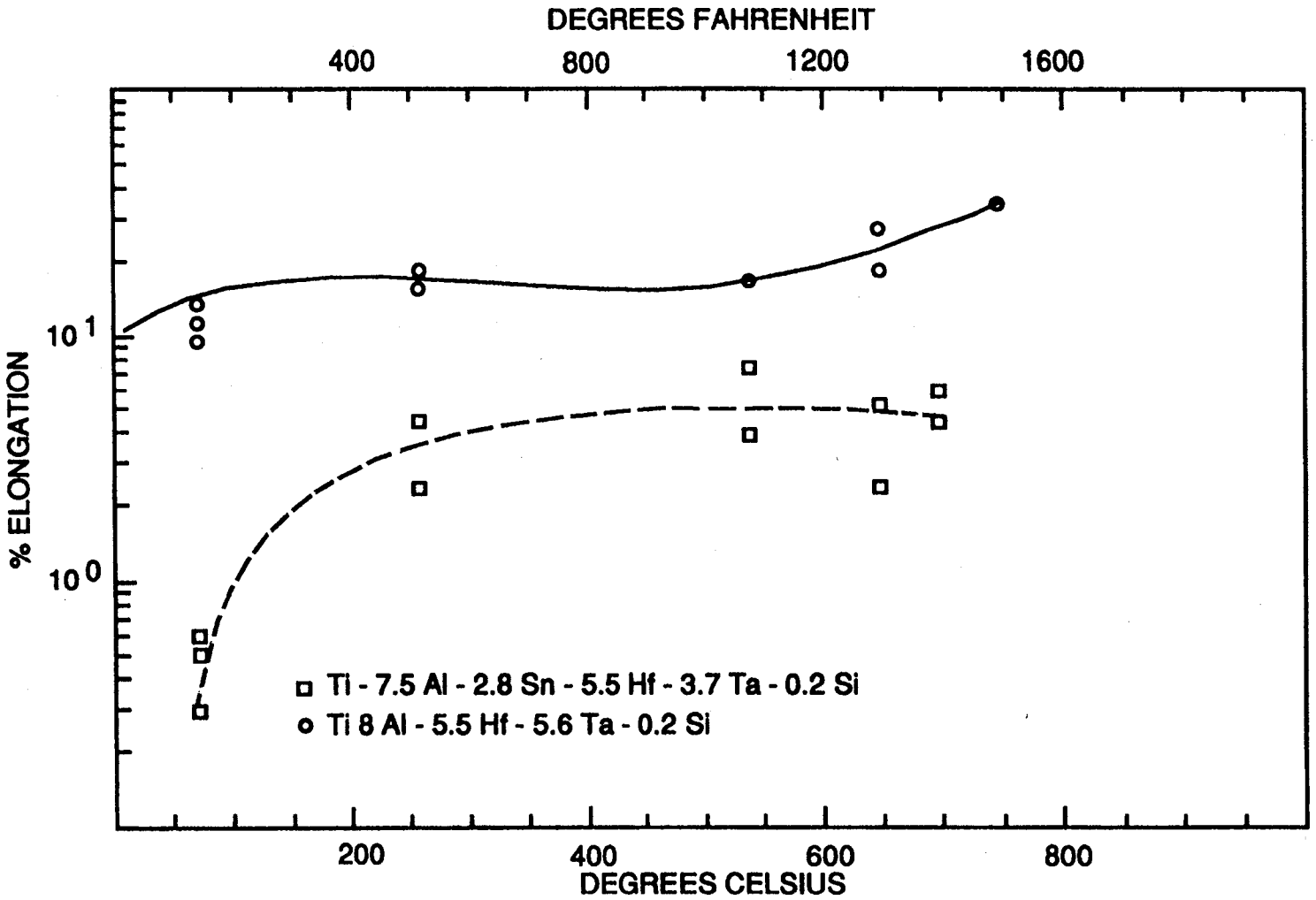
FIG. 3 is a graph of the tensile ductility of high strength alpha titanium alloys versus temperature in degrees Celsius and Fahrenheit, showing the superior ductility for the claimed alloy.

The tensile ductility of the $Ti_{(BALANCE)}$-8 wt. % Al-5.5 wt. % Hf-5.6 wt. % Ta-0.2 wt. % Si alloy is unexpectedly high for this strength level. By comparison, tensile tests were conducted on an extrusion of prior art composition $Ti_{(BALANCE)}$-7.5 wt. % Al-2.8 wt. % Sn-5.5 wt. % Hf-3.7 wt. % Ta-0.2 wt. % Si. The room temperature ductility of the $Ti_{(BALANCE)}$-7.5 wt. % Al-2.8 wt. % Sn-5.5 wt. % Hf-3.7 wt. % Ta-0.2 wt. % Si alloy ranged from 0.05 to 0.6%, which is undesirably low. The ductilities are graphically compared in FIG. 3.

Figure 4:
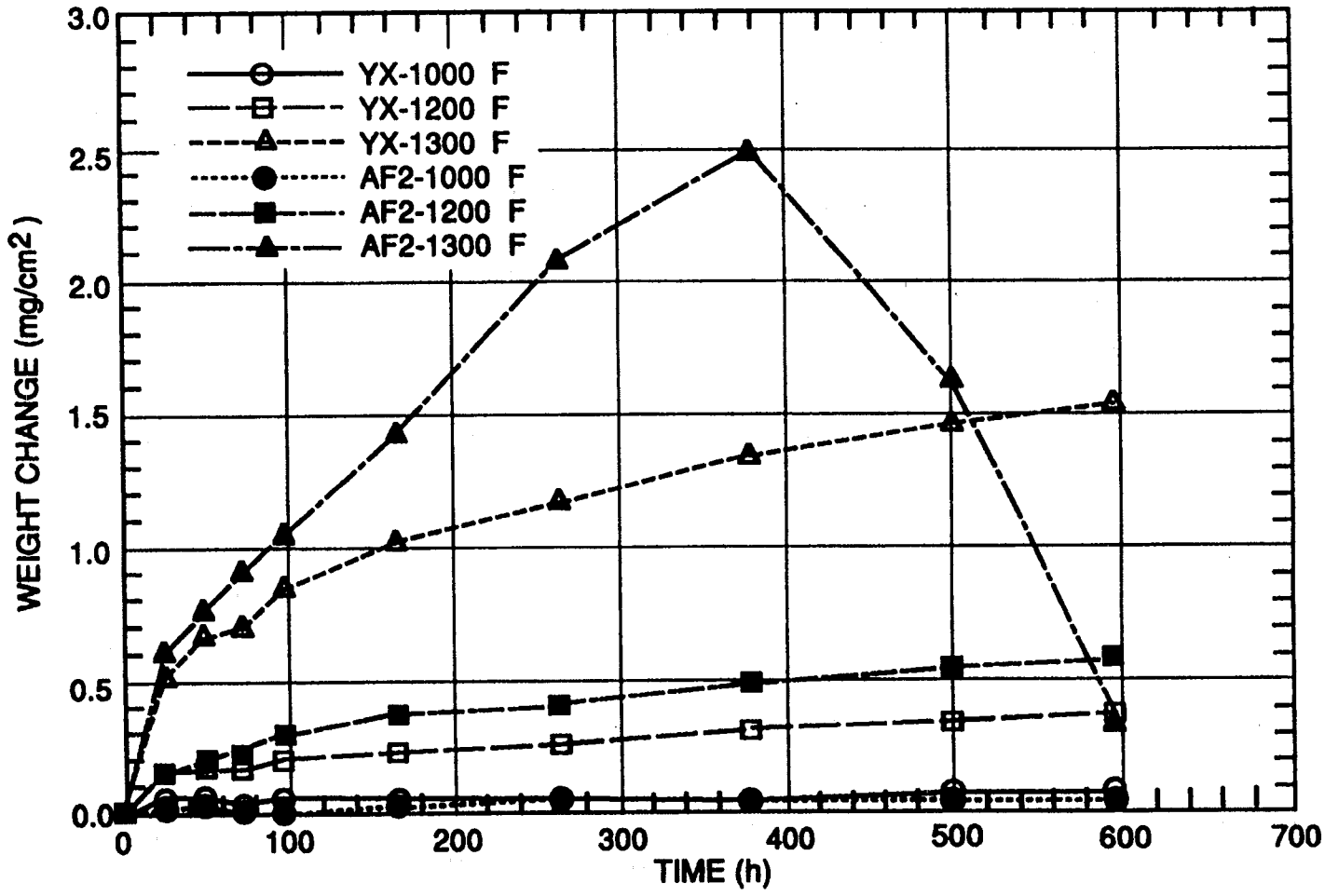
FIG. 4 is a graph depicting the results of the cyclic oxidation behavior of two alpha titanium alloys.

The oxidation resistance of the $Ti_{(BALANCE)}$-8 wt. % Al-5.5 wt. % Hf-5.6 wt. % Ta-0.2 wt. % Si alloy is very good and makes the alloy further attractive as a matrix for a composite. The claimed alloy was shown to have better oxidation resistance than AF2, an oxidation resistant high temperature alloy. Alloy AF2 corresponds to the composition of alloy 13 of U.S. Pat. No. 4,906,436. In atomic percent, alloy 13 consists of 81.9% titanium, 12.3% aluminum, 1.7% zirconium, 0.7% hafnium, 1.4% tin, 0.6% columbium, 0.1% molybdenum, 0.8% erbium, and 0.5% silicon. This was done by cycling in air at 1000° F., 1200° F., and 1300° F., sample pins of the claimed alloy, YX, and alloy AF2, which measured 0.9 in long by 0.17 in diameter. The cycle was 20 minutes to heat the samples, 30 minutes at temperature, and 30 minutes to cool the samples to room temperature. Weight change measurements were made every 24 hours for the first 100 hours and every 100 hours thereafter. FIG. 4 shows alloy YX is more resistant to cyclic oxidation at all temperatures than alloy AF2. The resistance of alloy AF2 declined significantly after 480 hours at 1300° F.

What is claimed is:

1. A titanium base alloy which is substantially free of tin consisting essentially of the following ingredients in weight percent:

| Ingredient | Ingredient Concentration | |
|---|---|---|
| | From About | To About |
| Titanium | balance | |
| Aluminum | 7.5 | 8.5 |
| Hafnium | 4.0 | 6.0 |
| Tantalum | 4.0 | 6.5 |
| Silicon | 0 | 0.5. |
| Scandium, Yttrium, or Lanthanum Group Elements | 0 | 0.5 |

2. A titanium alloy consisting essentially of about 8 weight percent aluminum, about 5.5 weight percent hafnium, about 5.6 weight percent tantalum, about 0.2 weight percent silicon, substantially free of tin, and the balance titanium.

3. A fiber reinforced composite including a matrix phase of a titanium base alloy according to claim 1.

4. The composite according to claim 3 wherein the fiber is selected from the group consisting of carbon fibers and silicon carbide fibers.

* * * * *